US011849774B2

(12) United States Patent
Wren

(10) Patent No.: US 11,849,774 B2
(45) Date of Patent: Dec. 26, 2023

(54) UNDERGARMENT

(71) Applicant: DEFY WEAR LLC, Westminster, CO (US)

(72) Inventor: Kimberly Wren, Westminster, CO (US)

(73) Assignee: DEFY WEAR LLC, Westminster, CO (US)

( * ) Notice: Subject to any disclaimer, the term of this patent is extended or adjusted under 35 U.S.C. 154(b) by 0 days.

(21) Appl. No.: 17/002,708

(22) Filed: Aug. 25, 2020

(65) Prior Publication Data

US 2022/0061406 A1 Mar. 3, 2022

(51) Int. Cl.

| | |
|---|---|
| ***A41B 9/14*** | (2006.01) |
| ***A41D 27/08*** | (2006.01) |
| ***A41B 9/00*** | (2006.01) |

(52) U.S. Cl.

CPC ..... *A41B 9/14* (2013.01); *A41B 9/001* (2013.01); *A41D 27/08* (2013.01); *A41B 2400/44* (2013.01)

(58) Field of Classification Search

CPC ..... A41B 9/001; A41B 9/14; A41B 2400/44; A41B 9/002; A41B 9/008; A41B 9/04; A41B 2300/33; A41D 27/08; A41D 27/22; A41D 1/21; A41D 7/00; A41D 7/006; A41F 7/00; A41F 9/005; A61F 5/24; A61F 5/48

See application file for complete search history.

(56) References Cited

U.S. PATENT DOCUMENTS 503,520 A * 8/1893 Bennett ..... A41B 9/001 D5/19
690,635 A * 1/1902 Carter ..... A41B 9/001 2/400
770,596 A * 9/1904 Marrow ..... A41B 9/04 2/401
856,268 A * 6/1907 Lanouette ..... A41B 9/04 2/407
908,257 A * 12/1908 Harsh ..... A41B 9/001 2/400
964,697 A * 7/1910 Rogers ..... A41B 9/04 2/407
1,016,538 A * 2/1912 Ashworth ..... A41B 9/001 2/400
1,242,760 A * 10/1917 Benson ..... A41B 9/001 2/400

(Continued)

FOREIGN PATENT DOCUMENTS

CN 204861189 U 12/2015

OTHER PUBLICATIONS

Screen Shot of Commercially Available Third Party Undergarment for Sale From Aihihe (place of business unknown), as Advertised on amazon.com (https://www.amazon.com/aihihe-Stretch-Invisible-Seamless-Underwear/dp/B0843P6HD1), Retrieved at Least as Early as Jul. 22, 2020.

(Continued)

*Primary Examiner* — Clinton T Ostrup
*Assistant Examiner* — Raquel M. Weis

(57) ABSTRACT

An undergarment for generally covering the pelvic region of a wearer is adapted to finger graspable pulls shaped and located to aid a wearer with diminished motor capacity and/or manual (i.e., hand) dexterity to more easily put on and take off the undergarment independently, without needing precise finger, hand, and arm control. The undergarment desirably uses materials, color choices, and decorative trim and elements to make the finger pulls and/or to decorate the undergarment to make the undergarment look more aesthetically appealing and reduce resemblance to specialty medical garment used by medical patients.

12 Claims, 12 Drawing Sheets

(56) References Cited

U.S. PATENT DOCUMENTS 1,504,249 A * 8/1924 Klein ..... A41D 7/00 D2/737
1,565,022 A * 12/1925 Mattern ..... A41D 7/005 2/404
1,729,265 A * 9/1929 George ..... A41B 9/14 2/237
1,830,302 A * 11/1931 Townsend ..... A41F 19/00 2/314
1,886,255 A * 11/1932 Upland ..... A41D 7/005 2/407
1,984,875 A * 12/1934 Heyn ..... A41B 9/04 2/401
1,996,613 A * 4/1935 Daniel ..... A41D 7/005 2/407
1,998,140 A * 4/1935 Loew ..... A41B 9/002 2/403
2,055,858 A * 9/1936 Daniel ..... A41D 7/005 D2/738
2,058,970 A * 10/1936 Fiesh ..... A41D 7/005 2/403
2,080,246 A * 5/1937 Wengen ..... A41D 7/005 2/237
2,091,441 A * 8/1937 Hauser ..... A41D 7/00 D2/738
2,258,502 A * 10/1941 Perez ..... A41D 7/005 2/403
2,326,380 A * 8/1943 Miller ..... A41B 9/14 2/407
2,397,751 A * 4/1946 Roy ..... A41B 13/04 2/400
2,453,051 A * 11/1948 Vacca ..... A41D 7/005 D2/738
2,481,396 A * 9/1949 Cohen ..... A41C 1/08 450/95
2,483,076 A * 9/1949 Vacca ..... A41D 7/005 D2/738
2,489,083 A * 11/1949 Dubin ..... A41D 1/08 2/237
2,643,383 A * 6/1953 Brzozowski ..... A41C 1/02 450/143
2,671,222 A * 3/1954 Hochberg ..... A41F 5/00 2/400
3,007,175 A * 11/1961 Robson ..... A41F 9/02 2/221
3,601,130 A * 8/1971 Saltiel ..... A41B 9/14 2/407
3,654,630 A * 4/1972 Block ..... A41D 7/005 2/238
4,028,740 A * 6/1977 Luerken ..... A41D 7/005 2/67
4,188,672 A * 2/1980 Kalso ..... A41F 9/025 2/919
4,258,440 A * 3/1981 McGowan ..... A41D 13/1236 2/403
4,416,272 A * 11/1983 Nelkin ..... A41B 9/02 128/95.1
4,523,337 A * 6/1985 Leibowitz ..... A41B 9/14 2/237
4,920,769 A * 5/1990 Rickerl ..... A41B 9/004 2/406
5,303,424 A * 4/1994 Cromartie ..... A41D 7/005 2/DIG. 1
D414,012 S * 9/1999 Tobias ..... D2/742
6,044,491 A * 4/2000 Emery ..... A41C 1/02 2/46
6,101,634 A * 8/2000 Martinez ..... A41D 13/0007 128/845
6,240,560 B1 * 6/2001 DeCaro ..... A41B 9/002 2/67
6,327,714 B1 * 12/2001 Koerner ..... A41F 9/002 2/311
6,473,941 B2 * 11/2002 Mei ..... A41F 9/007 24/561
D482,512 S * 11/2003 Slautterback ..... D2/712
6,715,155 B2 * 4/2004 Duflos ..... A41F 9/025 2/237
6,954,946 B2 * 10/2005 Goldfarb ..... A41F 9/002 2/338
7,168,096 B1 * 1/2007 Landa ..... A41C 3/0021 450/86
D679,070 S * 4/2013 Denning ..... D2/712
8,429,762 B2 * 4/2013 Weisman ..... A41F 9/00 2/237
D683,519 S * 6/2013 Denning ..... D2/712
9,015,867 B2 * 4/2015 Kenney ..... A41D 13/0017 2/229
9,943,118 B2 * 4/2018 Grzesik ..... A41B 9/001
10,010,120 B1 * 7/2018 Lowe ..... A41D 7/00
10,306,932 B1 * 6/2019 Martin ..... A61F 5/028
10,687,570 B2 * 6/2020 Strange ..... A41D 1/06
D960,494 S * 8/2022 Gladney ..... D2/712
2002/0099345 A1 * 7/2002 Saito ..... A41D 13/1254 604/359
2004/0000005 A1 * 1/2004 Holland ..... A44C 15/00 2/406
2006/0080753 A1 * 4/2006 Lee ..... A41D 7/00 2/69
2008/0040830 A1 * 2/2008 Holland ..... A41D 7/005 2/243.1
2008/0172769 A1 * 7/2008 Herget ..... A41F 9/02 2/311
2009/0094724 A1 * 4/2009 Lozano ..... A41D 7/00 2/323
2009/0204088 A1 * 8/2009 Stearman ..... A61F 13/68 604/386
2010/0275344 A1 * 11/2010 Demarest ..... A41F 9/025 112/475.13
2010/0299811 A1 * 12/2010 Murata ..... A41B 9/002 2/403
2010/0313336 A1 * 12/2010 Carlson ..... F41C 33/041 2/338
2011/0016614 A1 * 1/2011 Okada ..... A41B 9/004 2/240
2011/0197330 A1 * 8/2011 Simpson ..... A41D 7/00 2/243.1
2012/0060264 A1 * 3/2012 Wilkins ..... A41B 9/04 2/406
2012/0246791 A1 * 10/2012 Weisman ..... A41D 7/00 2/67
2012/0246805 A1 * 10/2012 Jones ..... A41F 17/00 2/400
2012/0311758 A1 * 12/2012 Nicholson ..... A41D 27/20 2/400
2013/0239300 A1 * 9/2013 Denning ..... A41D 27/00 2/400
2013/0269087 A1 * 10/2013 Rasmussen ..... A41B 9/001 2/400
2013/0283502 A1 10/2013 Denning
2014/0075651 A1 * 3/2014 Jones ..... A41F 17/00 2/400
2014/0101814 A1 * 4/2014 Caulfield ..... A41D 7/00 2/74
2014/0304899 A1 * 10/2014 Almonte ..... A41F 17/00 2/403
2014/0317832 A1 * 10/2014 Allen ..... A41D 1/06 2/236
2015/0320123 A1 * 11/2015 Kosmala ..... A44C 5/0007 2/67
2016/0007656 A1 * 1/2016 Grzesik ..... A41B 9/001 2/400
2016/0007658 A1 * 1/2016 Kim ..... A44B 18/0023 2/406
2016/0324238 A1 * 11/2016 Tran ..... A41B 1/06
2017/0027252 A1 * 2/2017 Inzer ..... A41B 9/001
2017/0035126 A1 * 2/2017 O'Leary ..... A41D 27/08
2017/0055613 A1 * 3/2017 Dames, III ..... A41F 15/002
2017/0105456 A1 * 4/2017 Hauser ..... A41D 13/129

(56) References Cited

U.S. PATENT DOCUMENTS

| | | | | |
|---|---|---|---|---|
| 2017/0325512 | A1* | 11/2017 | Trebino | A41B 9/001 |
| 2017/0325526 | A1* | 11/2017 | Barnabe | A41D 1/06 |
| 2018/0289085 | A1* | 10/2018 | Strange | A41D 13/1254 |
| 2019/0183199 | A1* | 6/2019 | Vorlop | A41F 9/025 |
| 2020/0008495 | A1* | 1/2020 | Anderson | A41D 13/0525 |

OTHER PUBLICATIONS

Machine Translation From EPO of CN204861189U.

Screen Shot of Commercially Available Third Party Undergarment for Sale From Easyundies LLC (Springfield, NJ) (https://easyundies.net/), as Advertised on amazon.com, Retrieved at Least as Early as Jul. 21, 2020.

Screenshot of Commercially Available Third Party Undergarment for Sale From EZsox (https://ezsox.com/collections/underwear), From the EZsox Website, Retrieved at Least as Early as Jul. 21, 2020.

Screenshot of Commercially Available Third Party Undergarment for Sale From Slick Chicks (New York, NY) (https://slickchicksonline.com/pages/how-it-works), From the Company Website, Retrieved at Least as Early as Aug. 9, 2020.

Merriam-Webster's Collegiate Dictionary, Merriam-Webster, https://unabridged.merriam-webster.com/collegiate/undergarment. Accessed on-line Oct. 7, 2022, print out attached.

Merriam-Webster's Unabridged Dictionary, Merriam-Webster, https://unabridged.merriam-webster.com/unabridged/trousers. Accessed on-line Oct. 7, 2022, print out attached.

Definition of "trousers" and of "uniform." Webster's College Dictionary, Random House, Inc., 1991, pp. 1430 and 1456, respectively.

* cited by examiner

UNDERGARMENT

FIELD OF THE INVENTION

The present invention relates to the field of undergarments for covering, generally, at least a portion of the pelvic region and/or lower torso when worn by a user.

BACKGROUND OF THE INVENTION

Undergarments (also sometimes conventionally referred to as underpants, underwear, panties, boxer shorts, and the like) are commonly known and are usually worn directly adjacent to a wearer's skin. At a most general level, conventional undergarments are provided with respective leg openings through which the wearer's legs are inserted (feet first) and a waist opening having a periphery that encircles the wearer's hips (i.e., around an upper region of the wearer's pelvis) or waist (i.e., the region generally axially between the wearer's pelvis and a lower part of the wearer's ribcage), once the undergarment is manually drawn up over the legs to the pelvic region as desired.

The process of donning and doffing an undergarment of this type is relatively simple for many, but a certain number of people suffer from injury (e.g., from traumatic accident) or medical conditions that cause varying degrees of loss of manual dexterity and strength (e.g., in the hands, particularly a pinching grip between the fingertips and the thumb) or motor control of the limbs (e.g., of the arms) that can make it extremely difficult to grasp a specific desired part of the thin fabric edge of an undergarment waist opening and/or to maintain one's grip on the fabric and/or to draw the undergarment up the legs around the body (or down, when removing the undergarment). Stroke or cerebral hemorrhage, or diseases with neurological effects like Parkinson's disease or multiple sclerosis are common causes of relevant loss of dexterity or motor control.

One conventional approach to facilitate putting on and taking off an undergarment is to, most generally, simply eliminate the action of drawing the undergarment up or down over the legs, to or away from the pelvic region where it is positioned when worn. One approach is provide a clam-shell or diaper-like structure which is passed between the legs of the wearer thereby positioning a front portion of the undergarment in front of the wearer, and a back portion of the undergarment behind the wearer. The front and back portions are then brought upward towards the wearer and respective opposing edges of the front and back portions are detachably fixed to one another at the sides of the wearer. For example, a commercially-available undergarment from a company called "Slick Chicks" located in New York City uses eye-and-hook fasteners (similar to those used in certain bras) to fix the front and back portions together. Another commercially-available undergarment from a company called "EasyUndies" in Springfield, New Jersey uses opposing hook-and-loop fastener strips on the respective opposing edges of the front and back portions to detachably fix the front and back portions together. Chinese Utility Model No. 204861189U discloses an undergarment also having a diaper-like structure that uses hook-and-loop fastener strips (similar to the EasyUndies undergarment) to fix its front and back portions together. While the diaper-like structure of these undergarments do facilitate their uses in certain aspects, they may have certain negative associations for wearers—in particular, adults may be embarrassed by having to use a garment that indeed resembles a diaper.

In addition, the physical structure of this type of undergarment still does not address the difficulties for dexterity-limited wearers trying to use a conventional unitary undergarment (i.e., that is drawn up and down over the legs when worn and taken off).

SUMMARY OF THE INVENTION

Accordingly, there is a need for an undergarment adapted to address the physical limitations of people with dexterity and motor control issues that permits ease of use, and preferably additionally encompasses a stylish or otherwise visually attractive appearance in a manner so as to not look like drab specialized medical gear, thereby contributing to a wearer's positive self-image.

BRIEF DESCRIPTION OF THE DRAWINGS

The present invention will be even better understood with reference to the drawings appended hereto, taken in combination with the written description hereinbelow, in which.

DETAILED DESCRIPTION OF THE PRESENT INVENTION

Most generally, the present invention relates to undergarments worn around and generally covering the pelvic region of a wearer. Such garments may be variously referred to as underwear, underpants, panties, briefs, or boxers among other terms, and the application of the present invention is meant to be expansively inclusive with respect to such terminology.

Also, at the outset, reference will be sometimes made herein to a "front," "rear," and "side" or "sides" of an undergarment according to the present invention. For the sake of clarity, the following standards will be used herein with reference to standard anatomical planes, taken with respect to an undergarment as worn by a wearer in customary use. The "front" and "rear" of the undergarment are taken as generally defined on opposites sides of the coronal plane, corresponding to anterior and posterior sides of the wearer, respectively. A "side" or "sides" of the undergarment are taken as regions of the undergarment intersecting or at least substantially adjacent to the lateral regions of the undergarment intersecting the coronal plane. A seam fixedly joining and located between respective fabric panels constituting the undergarment may be located at one or both sides of the undergarment.

In general, the present invention relates to undergarments provided with additional structures that aid a wearer with dexterity and/or motor skill difficulties to readily put on and take off the undergarment as desired, preferably independently.

The appended figures collectively illustrate four examples of the present invention by way of illustration. Certain features described herein (for example, potential fabrics of manufacture of the respective undergarment examples) are common to the respective examples and should be so understood even without express mention. The features of the respective examples as described herein are intended to be interchangeable to the maximum extent possible.

Figure 1A:
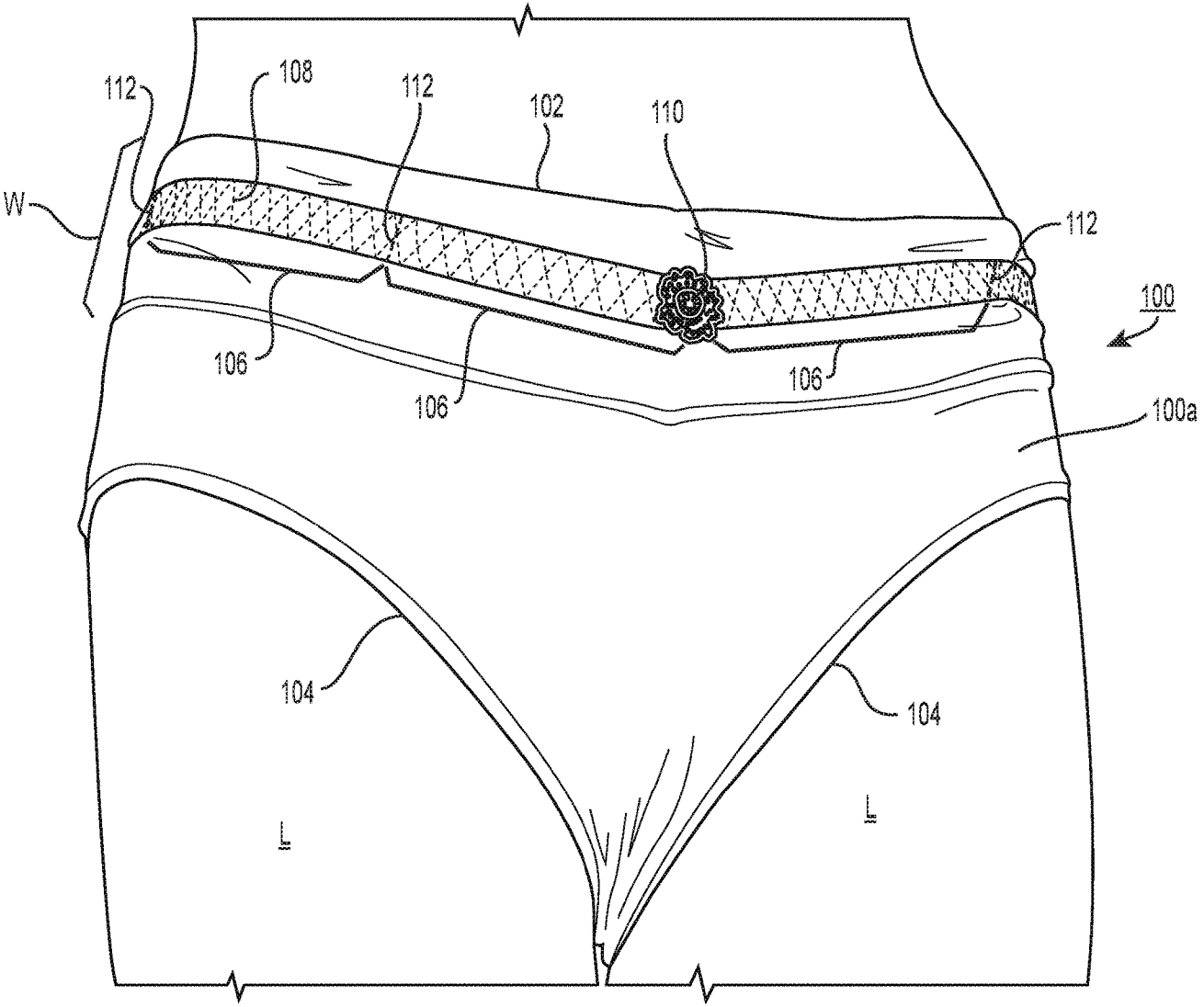
FIGS. 1A-C are front, rear perspective, and close-up views of a first example of an undergarment according to the present invention.
Figure 1B:
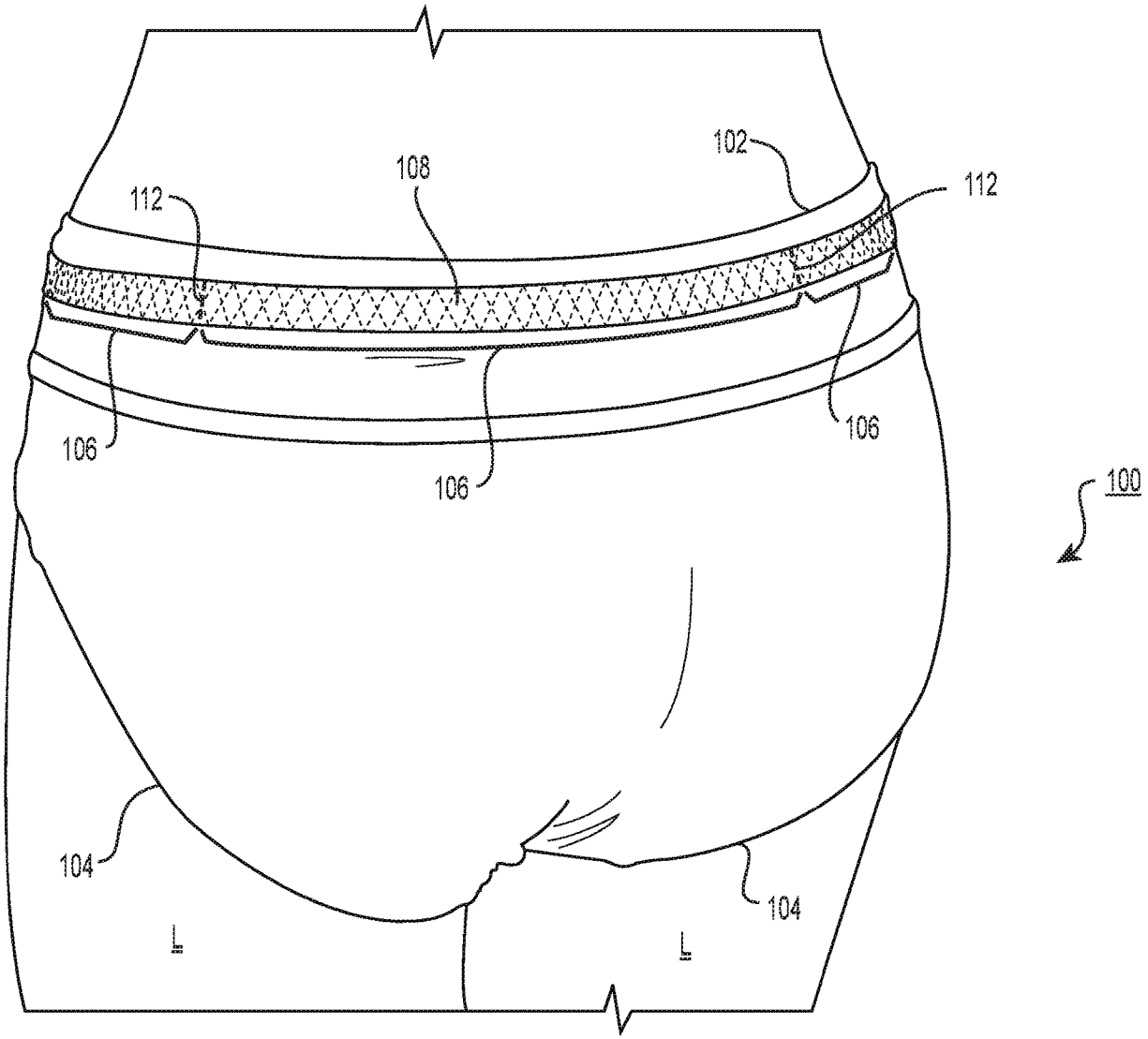
Figure 1C:
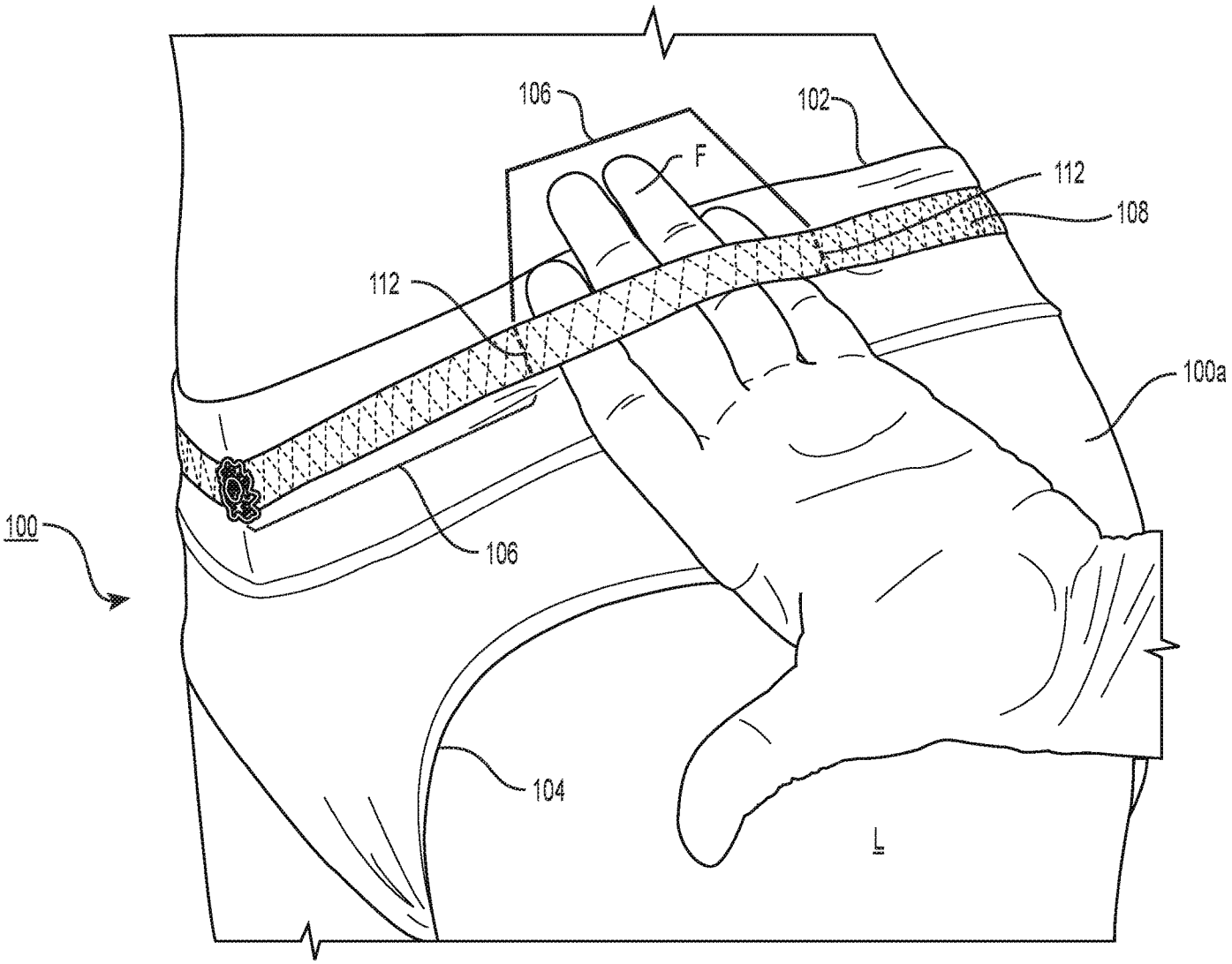

FIGS. 1A-1C illustrate a first example of an undergarment 100 according to the present invention. The undergarment 100 includes a main garment portion 100*a* that is provided with a waist opening 102 and respective leg openings 104. As is conventionally known, a periphery of the waist opening 102 may be elasticized (for example, either by choice of material or by adding a strip of elastic material around the waist opening to form a waistband) in order to keep the waist opening 102 snug against the wearer's body so as to keep the undergarment 100 in place once drawn up the legs L and around the waist or hips W of the wearer. The peripheries of the respective leg openings 104 may also be optionally elasticized as desired.

Main garment portion 100*a* can be made from a variety of materials common in the field of undergarment manufacture, including, without limitation, cotton, nylon, silk, or other known synthetic materials (optionally resiliently stretchable) chosen for any desired combination of personal comfort and/or aesthetic appearance. The main garment portion 100*a* may be made from one or more respective segments or panels of fabric material, preferably fixed together at respective seams (for example, via stitching) to form a one-piece (i.e., unitary) garment (particularly, in contrast to the split-side (i.e., diaper-like) structure of the prior art garments described above).

At a location at or near the waist opening 102, one or more laterally extending elongate strips of material are attached to the main garment portion 100*a* at laterally spaced apart intervals to define a plurality of horizontally extending primary finger pulls 106. In one example of the present invention, a single strip of an elastic material 108 (e.g., about ½ inch wide) is attached (for example, via conventional stitching using a thread suitable to the respective materials; sometimes referred to in the art as "tacking") to the main garment portion 100*a* at laterally spaced apart attachment locations 112 (for example at about 3-4 inch intervals). Preferably the strip of elastic material 108 is tacked in particular to the main garment portion 100*a* at respective left and right sides thereof, in addition to the other spaced apart points of attachment, and its respective ends are tacked at approximately the front center of the main garment portion 100*a*. As a result, in one example according to the present invention, the undergarment 100 is provided with, for example, two horizontally extending primary finger pulls 106 between the front center of the main garment portion 100*a* and the respective right and left sides of the main garment portion 100*a*, respectively, for a total of four, for example, on the front side of the undergarment 100. Depending on the spacing of the attachment locations 112 on the rear side of the undergarment 100, three or four (for example) horizontally extending primary finger pulls 106 may be provided (as seen in FIG. 1B) across the back of the undergarment 100. It is a broad objective to provide the wearer with a number of horizontally extending primary finger pulls 106 distributed about (i.e., on a combination of the sides and front and/or rear of the undergarment 100) the waist opening 102 that can be more easily grasped (despite any dexterity or motor control problems the wearer may have) so that the undergarment 100 can be pulled up evenly and the waist opening 102 positioned evenly. Accordingly the number of points at which strip of elastic material 108 is attached may vary in a number of ways, subject to the desired provision of horizontally extending primary finger pulls 106 with the desired distribution about the undergarment 100.

Relatedly, more than one strip of elastic material 108 can be used, instead of a single strip completely encircling the undergarment 100. In an alternative example, not shown, a first strip could be attached between the center front and a first respective side, a second strip could be attached between the center front and the second respective side, a third strip attached between first respective side and the center rear, and a fourth strip attached between the second respective side and the center rear. Additionally, each of the first, second, third, and fourth strips could be attached to the main garment portion 100*a* at additional intermediate tacking locations to define further horizontally extending primary finger pulls 106.

For example, if finger pulls were only provided on the sides of the undergarment 100, different from the presently claimed invention, the sides of the undergarment 100 would tend to be undesirably pulled up unevenly higher than the front and rear parts of the waist opening 102, but the wearer would not have an easy ability to adjust the front and rear parts of the undergarment 100 for lack of suitably positioned finger pulls. A similar problem would exist if finger pulls were provided only on the front center and rear center of the undergarment 100—the front and rear of the undergarment 100 would be pulled up unevenly higher than the sides, without an easy ability to adjust the sides correspondingly.

The horizontally extending primary finger pulls 106 provide a handle-like structure that have a slight space formed between the strip of elastic material 108 and the fabric of the main garment portion 100*a*, facilitating manual gripping of the undergarment 100 when it is put on and taken off. By "slight" it is meant that the spacing between the relative portion of strip of elastic material 108 and the underlying main garment portion 100*a* is sufficiently open to easily permit the wearer to slide one or more fingers F therebetween on the one hand, without the strip of elastic material 108 excessively sagging away from the underlying main garment portion 100*a* in an unsightly manner. See, FIG. 1C, for example. In this regard, it can be useful to use an elastic or otherwise resiliently stretchable material for strip 108, which can balance ease of access for the wearer's fingers with retaining a pleasing shape and form.

Optionally but desirably, the elongate strip 108 of elastic material may be a color the same as, or a color considered aesthetically complimentary to, the color of the undergarment 100. The location at which the free ends of the elongate material are stitched down may additionally be hidden with an aesthetically pleasing decorative element, such as a decorative fabric flower element 110 or other similarly decorative element (which can additionally have a functional protective role in protecting the ends of the strip of elastic material 108 from fraying or otherwise wearing and/or protect the stitching at attachment locations 112 fixing the ends of the strip of elastic material 108). The use of such decorative features helps make the undergarment more aesthetically "mainstream" instead of looking like specialized medical clothing used for, for example, the sick and invalid.

A feature of the present invention is the location of the primary finger pulls about the periphery of the undergarment 100. According to the present invention, at least one primary finger pull is provided to assist the wearer in putting on and taking off the undergarment 100. Although one horizontally extending primary finger pull 106 according to the present invention is helpful and functional in this sense, the provision of more than one horizontally extending primary finger pull 106 is even more preferable, and the provision of at least three horizontally extending primary finger pulls 106 (located about the periphery of the waist opening of the undergarment) is even more useful—particularly for better permitting the undergarment to be evenly pulled up to the body by wearer.

FIG. 1B is a rear perspective view illustrating in further detail the side and rear of the undergarment 100 as seen in FIG. 1A. FIG. 1C illustrates an example of a wearer extending fingers through one of the horizontally extending primary finger pulls 106.

Figure 2A:
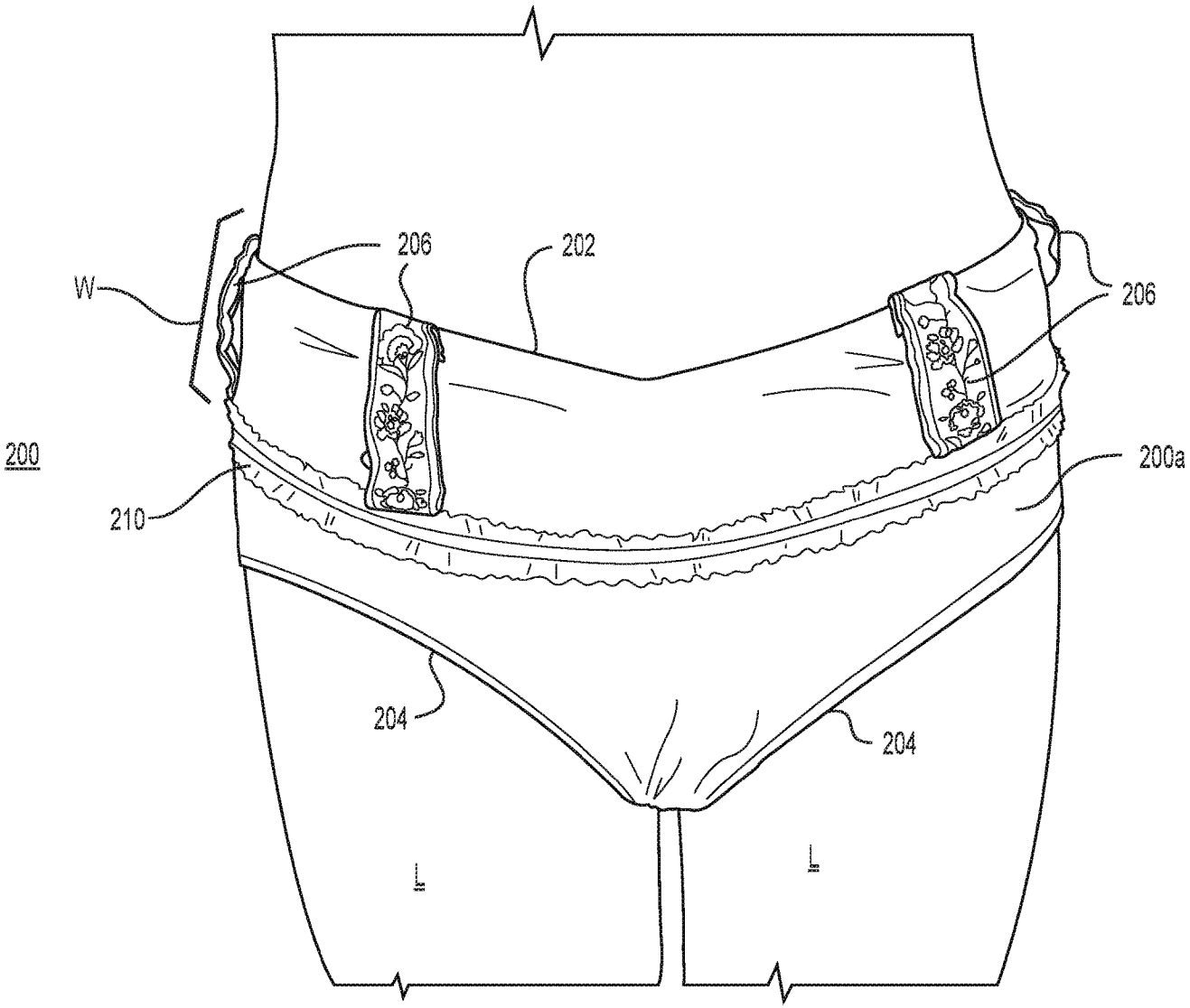
FIGS. 2A-2C are right side, right rear perspective, and close-up views of a second example of an undergarment according to the present invention.
Figure 2B:
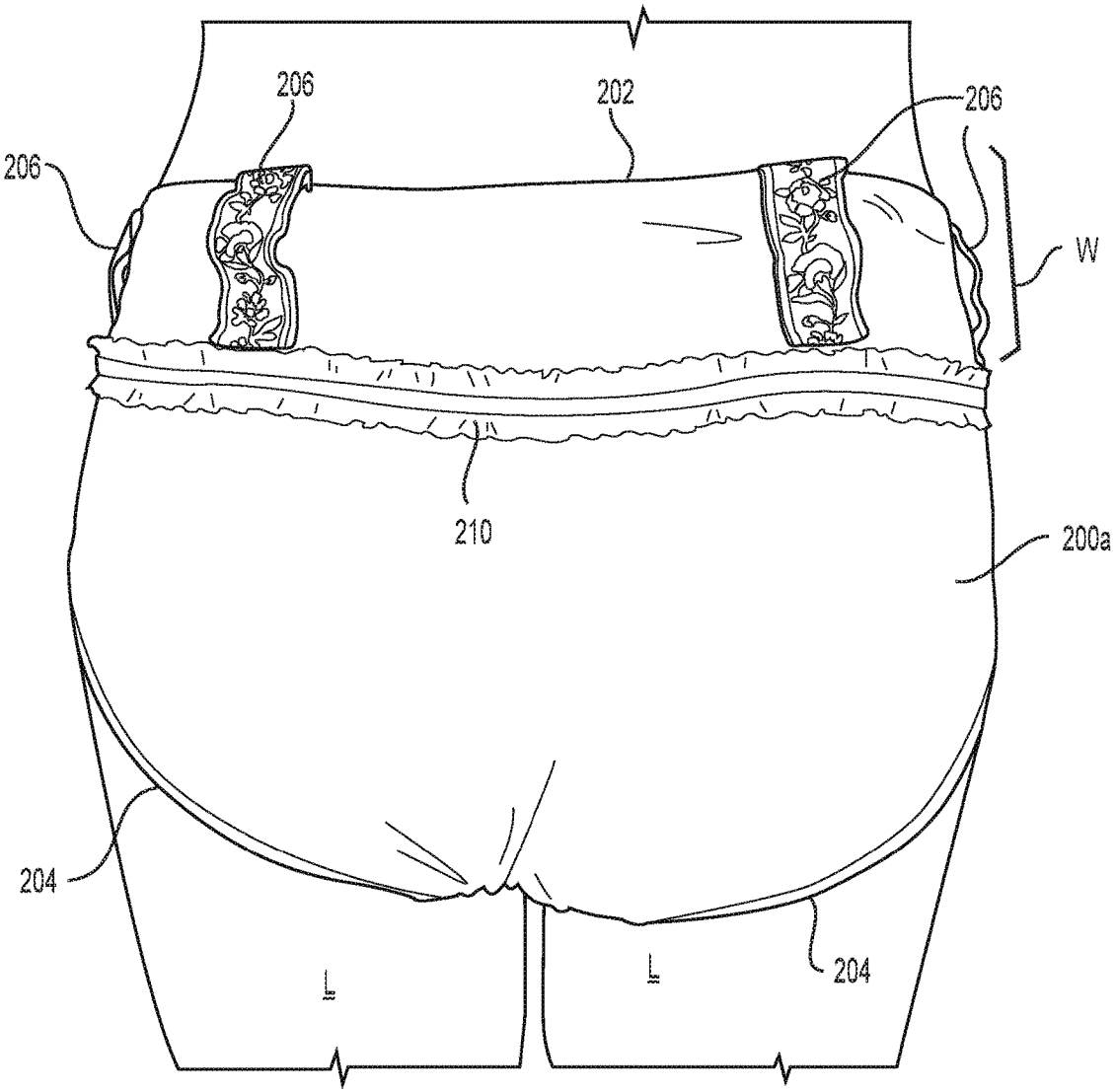
Figure 2C:
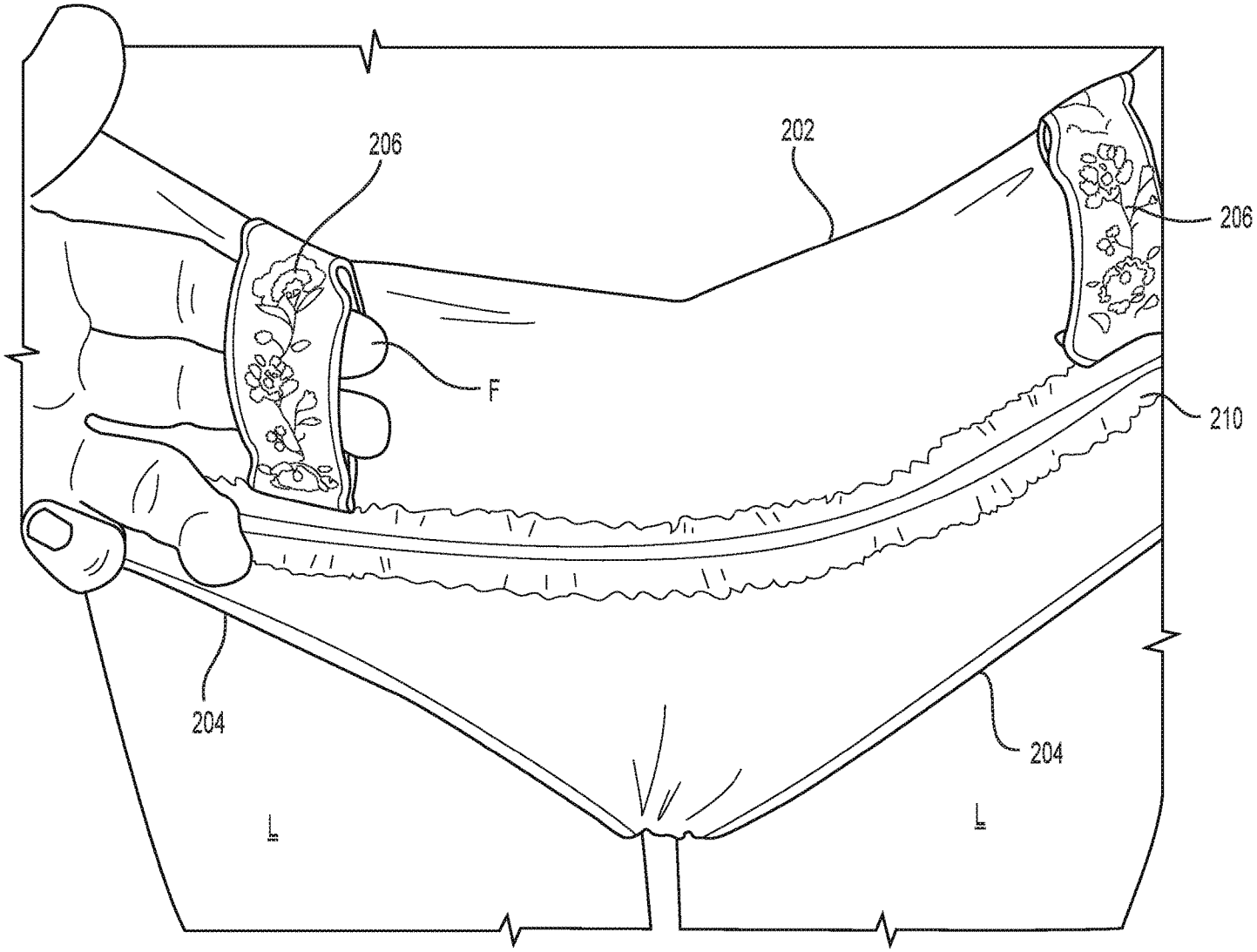

FIGS. 2A-2C illustrate a second example of an undergarment 200 according to the present invention. FIG. 2A is a front view of undergarment 200, which, similar to undergarment 100, comprises a main garment portion 200*a* having a front side, a rear side, and respective lateral sides. The main garment portion 200*a* is provided with a waist opening 202 and respective leg openings 204. As is conventionally known, a periphery of the waist opening 202 may be elasticized (for example, either by choice of material or by adding a strip of elastic material around the waist opening to form a waistband) in order to keep the waist opening 202 snug against the wearer's body so as to keep the undergarment 200 in place once drawn up the legs L and around the waist or hips W of the wearer. The peripheries of the respective leg openings 204 may also be optionally elasticized as desired.

Most of the same structural features and considerations raised above relative to the first example apply correspondingly here. However, in this second example of the present invention, the undergarment 200 includes a plurality of generally vertically extending primary finger pulls 206, in contrast to the horizontally extending primary finger pulls 106 of the first example. In this example, six vertically extending primary finger pulls 206 are provided, two vertically extending primary finger pulls generally at the opposing sides of the undergarment 200, two vertically extending primary finger pulls 206 on the front of the undergarment 200, and two vertically extending primary finger pulls 206 on the rear side of the undergarment 200. (See also the rear perspective view of FIG. 2B, and FIG. 2C, which illustrates a wearer's finger(s) inserted into one of the vertically extending primary finger pulls 206.)

Vertically extending primary finger pulls 206 may be made out of respective strips of material for example, about 3 inches long, that extend between respective spaced apart locations at or adjacent to waist opening 202, generally vertically downward (i.e., generally perpendicular to waist opening 202), so as to be stitched (or otherwise attached) to the underlying undergarment 200 at respective ends thereof. Preferably, the length of each strip is sufficient, relative to the distance between locations at which its ends are tacked to the undergarment 200, to leave a slight slack space between each strip and the underlying undergarment 200 to facilitate slipping one or more fingers F of the wearer therebetween. (See, for example, FIG. 2C.) The vertically extending primary finger pulls 206 may be made out of elastic or other stretchable fabric, or may alternatively be made from a generally inextensible fabric of suitable length to permit a slight space underneath for fingers to be inserted therethrough. As seen in FIGS. 2A-2C, the vertically extending primary finger pulls 206 may be desirably made from a fabric having a decorative design or pattern to desirably add to the visual attractiveness of the undergarment 200. Undergarment 200 is optionally further provided with decorative trim 210 extending around the circumference of the article.

The, for example, two vertically extending primary finger pulls 206 provided on the front and rear of the undergarment 200 may be located at respective locations between the front center and rear center of the undergarment 200, and the respective sides of the undergarment, as seen in FIGS. 2A-2B. Overall, however, considerations similar to those discussed above relative to the first example of the present invention apply as to the number, location, and spacing of the respective vertically extending primary finger pulls 206.

The use of horizontally extending primary finger pulls 106 versus vertically extending primary finger pulls 206 address different issues that a wearer may have regarding motor control of the limbs and dexterity issues of the hands and fingers, requiring differing directions of accessing the finger pulls. For example, different people may have different manifestations of difficulties. Whereas the difficulties of a wearer suffering from partial paralysis may be relatively fixed and consistent, the physical challenges for someone suffering from, for example, Parkinson's disease, may vary over time, including having different tremor behaviors at different times. In essence, it may sometimes easier to reach laterally through a vertically extending primary finger pull 206, and other times easier to reach vertically through a horizontally extending primary finger pull 106.

Figure 3A:
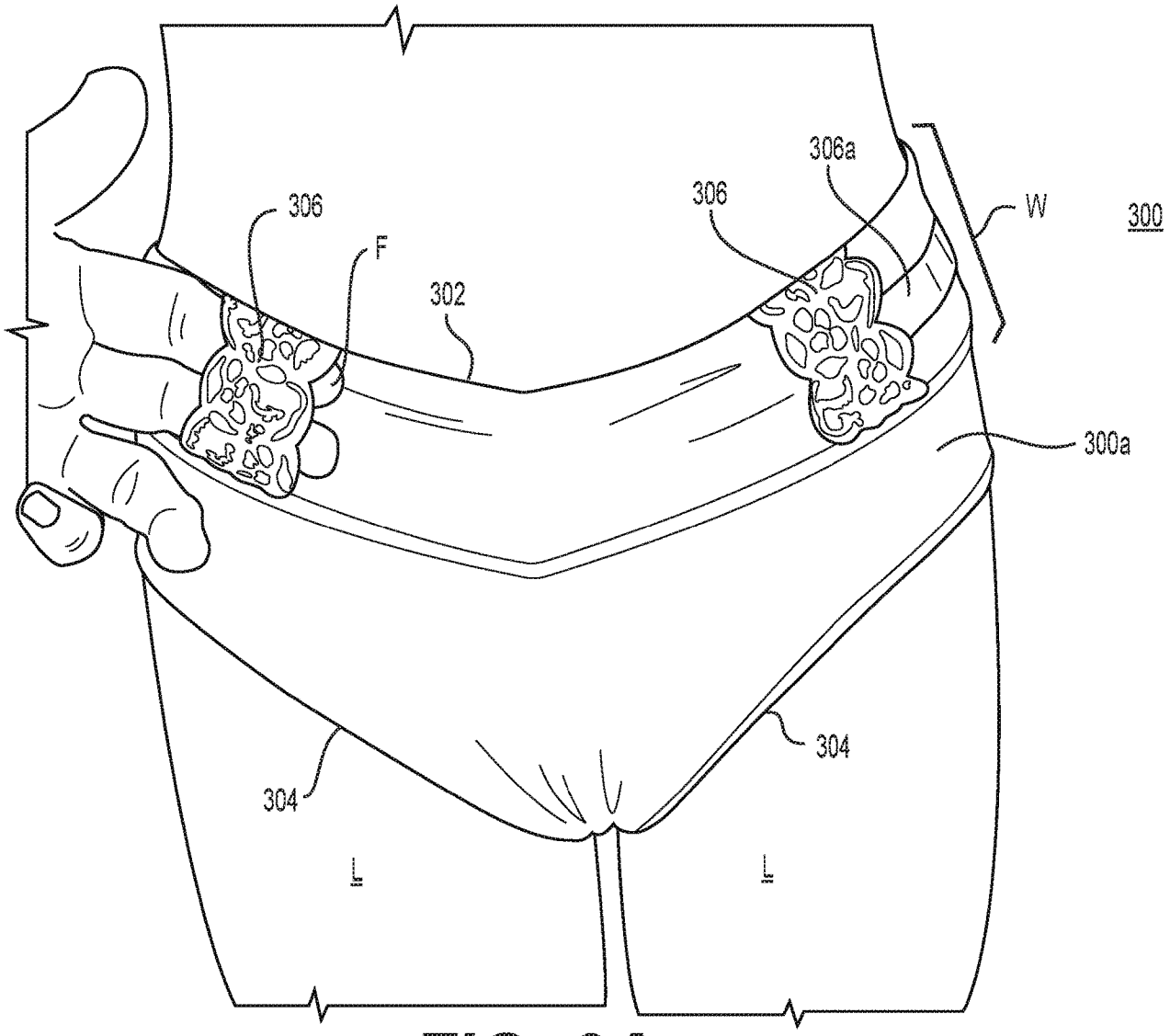
FIGS. 3A-3C are front, rear perspective, and close-up right side views of a third example of an undergarment according to the present invention.
Figure 3B:
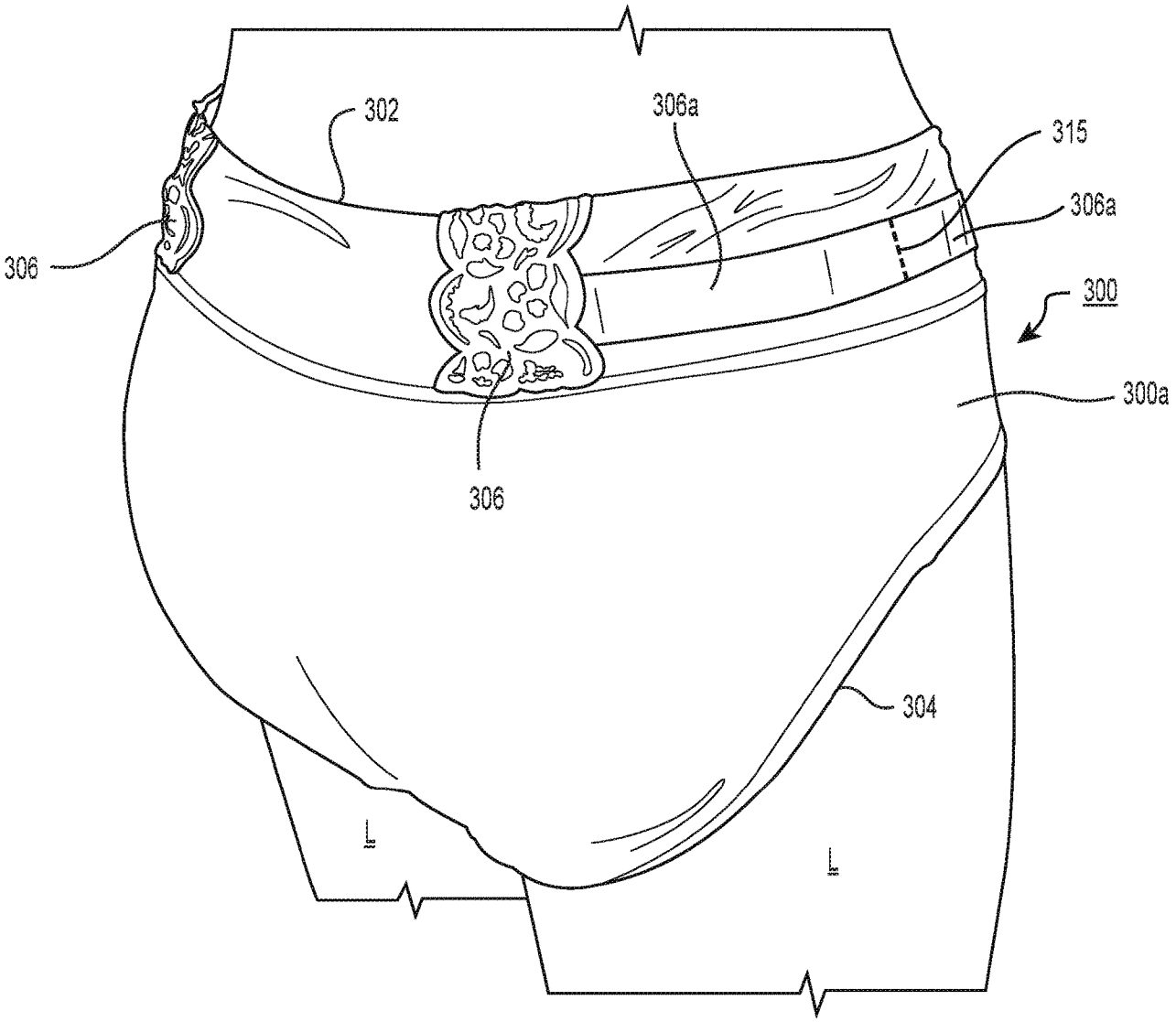
Figure 3C:
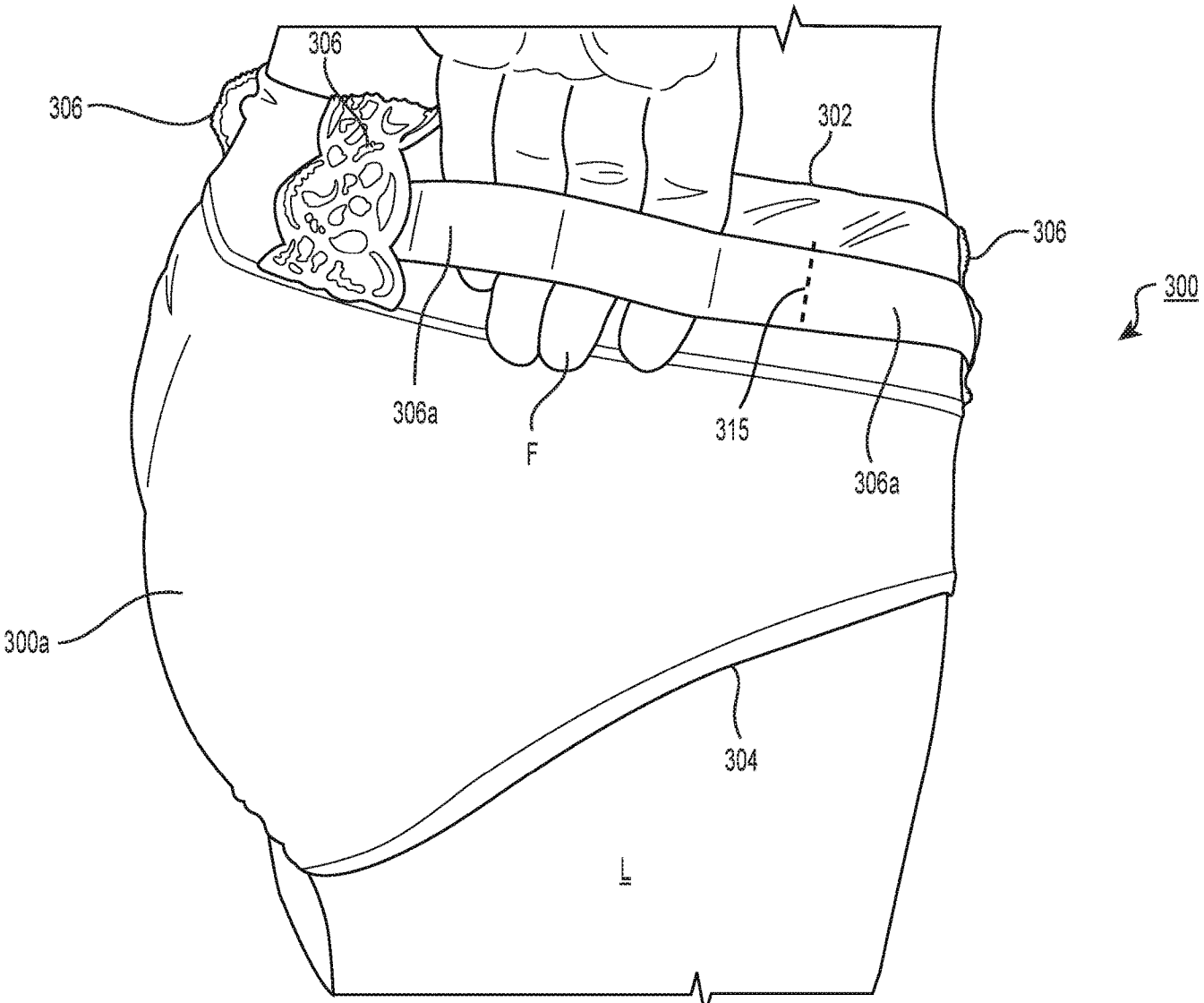

Accordingly, FIG. 3A-3C illustrate a third example of an undergarment 300 according to the present invention. The undergarment 300 comprises a main garment portion 300*a* having a front side, a rear side, and respective lateral sides. The main garment portion 300*a* is provided with a waist opening 302 and respective leg openings 304. As is conventionally known, a periphery of the waist opening 302 may be elasticized (for example, either by choice of material or by adding a strip of elastic material around the waist opening to form a waistband) in order to keep the waist opening 302 snug against the wearer's body so as to keep the undergarment 300 in place once drawn up the legs L and around the waist or hips W of the wearer. The peripheries of the respective leg openings 304 may also be optionally elasticized as desired.

Broadly, this third example of the undergarment 300 according to the present invention provides both horizontally extending finger pulls (as in the first example, relative to FIGS. 1A-1C) and vertically extending finger pulls (as in the second example, illustrated in FIGS. 2A-2C). Accordingly, different from the first and second examples of the present invention set out above, where only horizontally extending finger pulls and only vertically extending finger pulls were provided, respectively, the horizontally extending finger pulls are referred to here as "primary" in pertinent part, whereas the vertically extending finger pulls are referred to as "secondary" in pertinent part in order to help distinguish between them in the following description of the third example.

In this third example, as seen in FIG. 3A-3C, four vertically extending secondary finger pulls 306 are provided by way of example: two on the front of the undergarment 300 partway between the front center and the respective sides, and two more on the rear of the undergarment, partway between the rear center and the respective sides (see, for example, FIG. 3B).

In addition, a plurality (e.g., four) of horizontally extending primary finger pulls 306*a* are provided: two each on the front and rear of the undergarment 300, respectively, located adjacent the sides of the undergarment 300. In one example, a center of a respective strip of material constituting the horizontally extending primary finger pulls 306*a* is tacked at 315 to the undergarment 300 generally at a lateral side of the undergarment 300 (see FIG. 3B for example). The respective ends of each strip of material extend towards the front side and to the rear side, respectively, to locations generally corresponding to respective vertically extending secondary finger pulls 306, where they are tacked or otherwise attached to the underlying undergarment 300. Preferably, the vertically extending secondary finger pulls 306 cover and/or hide the points at which the ends of the horizontally extending strips are tacked down, and therefore additionally serve to protect the stitching at those locations, in addition to functioning as finger pulls according to the present invention.

Optionally two additional vertically extending secondary finger pulls 306 (not shown) may be provided on the sides of the undergarment 300 in a location corresponding to, and hiding, the center location 315 (in FIG. 3B) at which the strips of material constituting horizontally extending primary finger pulls 306*a* are tacked to the undergarment 300.

The wearer can engage the vertically extending secondary finger pulls 306 in a manner similar to that already illustrated in FIG. 2C, relative to vertically extending primary finger pulls 206. See, for example, FIG. 3A. FIG. 3C is a right side view that illustrates how the wearer can grasp a horizontally extending primary finger pull 306*a* with fingers F. The features, characteristics, and structural considerations of the horizontally extending finger pulls relative to FIGS. 1A-1C and those of the vertically extending finger pulls relative to FIGS. 2A-2C apply equally to the third embodiment.

Figure 4A:
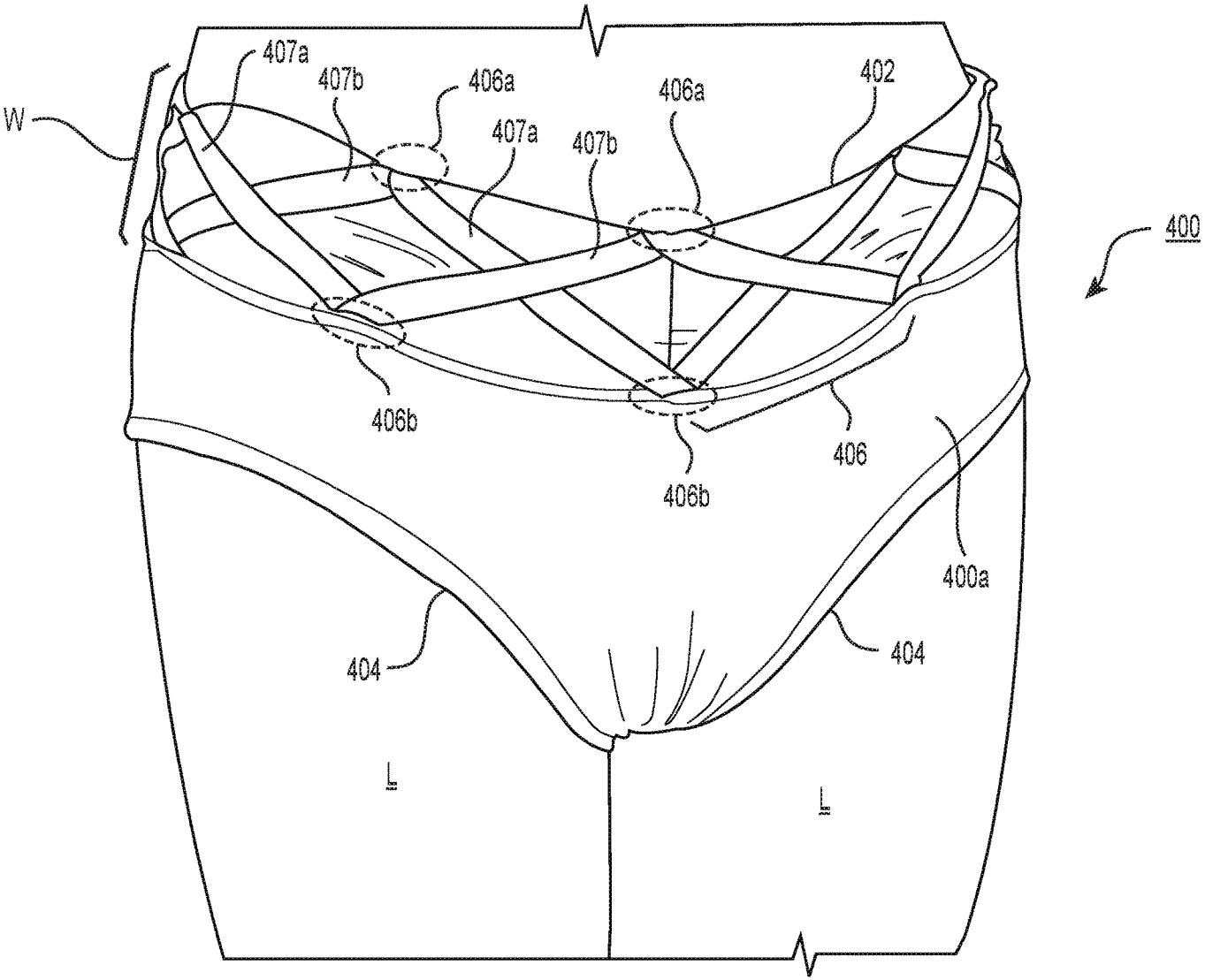
FIGS. 4A-4C are front, rear perspective, and close-up views of a fourth example of an undergarment according to the present invention.
Figure 4B:
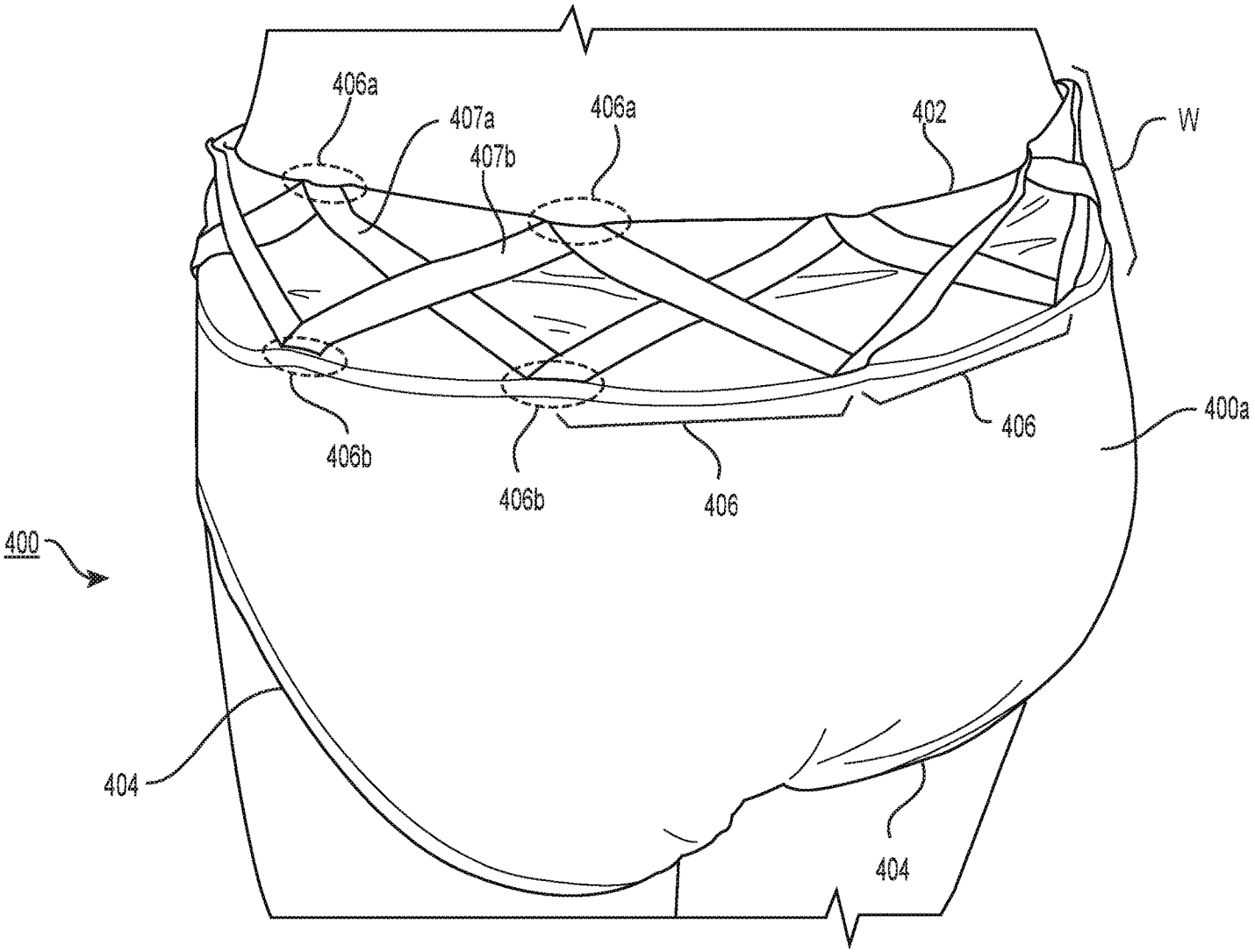
Figure 4C:
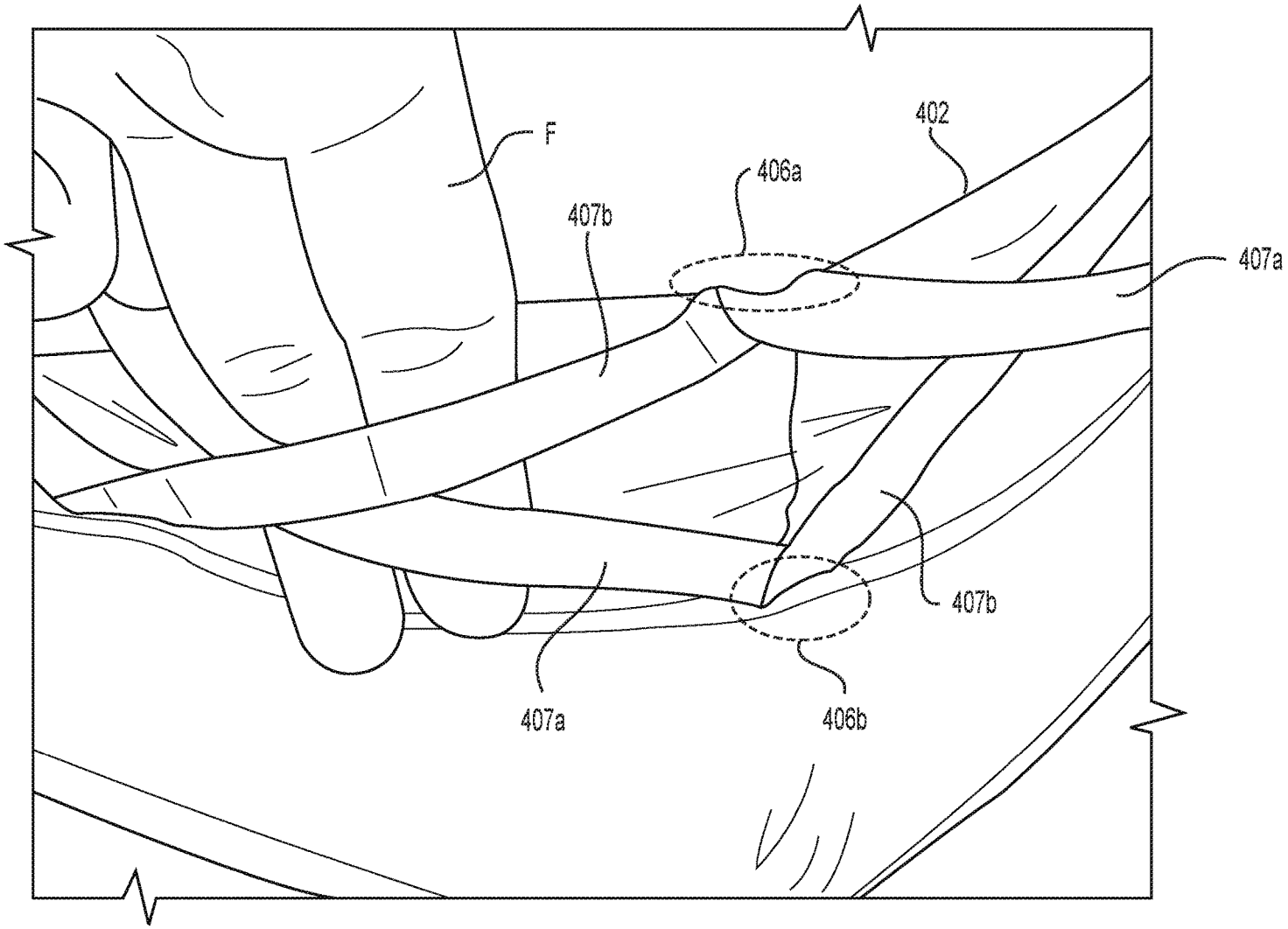

FIGS. 4A-4C illustrate a fourth example of an undergarment according to the present invention. Where the third example of the present invention discussed above provided a combination of separate vertical and horizontal finger pulls 306, 306*a*, the fourth example provides a combined finger pull structure that provides both horizontal and vertical finger access in the same structure.

In the fourth example, FIG. 4A is a front view of undergarment 400, which, similar to undergarments 100, 200, and 300, comprises a main garment portion 400*a* having a front side, a rear side, and respective lateral sides. FIG. 4B is a rear perspective view of the undergarment 400. The main garment portion 400*a* is provided with a waist opening 402 and respective leg openings 404. As is conventionally known, a periphery of the waist opening 402 may be elasticized (for example, either by choice of material or by adding a strip of elastic material around the waist opening to form a waistband) in order to keep the waist opening 402 snug against the wearer's body so as to keep the undergarment 400 in place once drawn up the legs L and around the waist or hips W of the wearer. The peripheries of the respective leg openings 404 may also be optionally elasticized as desired.

Most of the same structural features and considerations raised above relative to the first, second, and third examples apply correspondingly here. However, in this fourth example of the present invention, the undergarment 400 includes one or more generally X-shaped finger pulls 406, each comprising crossed, obliquely extending strips of fabric 407*a*, 407*b*. The strips of fabric 407*a*, 407*b* (e.g., ⅜" or ½" wide, optionally elastic or otherwise resiliently stretchable) are tacked to the underlying undergarment 400 at their tops (406*a*) (proximal to waist opening 402) and at their respective bottoms (406*b*). The location at which strips of fabric 407*a*, 407*b* intersect may be optionally attached to each other by stitching, but not to the underlying undergarment 400.

The X-shaped finger pulls 406 may be provided in a continuous series about the periphery of undergarment 400, as seen in FIGS. 4A-4C. Alternatively, the finger pulls may be provided as individual spaced apart elements about the periphery of the undergarment 400, using the same spacing considerations as discussed above relative to the prior examples of the present invention. The X-shape of the X-shaped finger pulls 406 provide a single convenient element that can be readily accessed from both the side (like the vertically extending finger pulls of the second and third examples of the present invention) and from the top (and/or bottom) like the horizontally extending finger pulls of the first or third examples. FIG. 4C illustrates how a wearer can engage his/her fingers into the X-shaped finger pull 406 from above, for example. Likewise, it will be appreciated that the wearer's fingers can alternatively engage with the X-shaped finger pull 406 from the side, in a manner similar to the vertically extending finger pulls of the other examples of the present invention.

While the present invention is described hereinabove by way of certain examples, it should be clearly understood that the invention as contemplated can be modified while remaining within the ambit of the broad concept of the invention. Again, all features described herein can be used with other features described to the fullest extent possible, even in the absence of specific linking language to that effect.

What is claimed is:

1. An undergarment for covering a wearer, comprising:

a main garment portion having a front side, a rear side, and respective lateral sides and formed from one or more panels of fabric, the main garment portion being provided with a waist opening and two respective leg openings defined by respective waist and leg opening peripheries, the waist opening periphery being located so as to encircle a wearer's waist or hips when the undergarment is worn, and the respective leg opening peripheries being located so as to receive the wearer's legs therethrough respectively and encircle a portion of the wearer's respective thighs when the undergarment is worn;

wherein the main garment portion is unitary, such that the one or more panels of fabric are fixedly joined together at at least one seam between respective edge portions of the one or more panels of fabric;

wherein the main garment portion is provided with:

a plurality of horizontally extending primary finger pulls each constructed and arranged to be manually graspable by the wearer to pull on, pull off, and/or adjust the undergarment as desired, the primary finger pulls each extending laterally at or adjacent to the waist opening periphery in a direction generally parallel thereto and each primary finger pull comprising an elongate portion of material with opposing ends fixedly attached to the main garment portion at respective laterally spaced attachment locations, wherein each elongate portion of material has a length greater than a distance between the laterally spaced attachment locations, thereby defining a respective space between the primary finger pull and the main garment portion and sized to permit at least one of the wearer's fingers to pass therethrough; and a plurality of vertically extending secondary finger pulls each also constructed and arranged to be manually graspable by the wearer to pull on, pull off, and/or adjust the undergarment as desired, the secondary finger pulls each being made from an elongate strip of material fixedly attached to vertically spaced apart attachment locations on the main garment portion at opposing ends of the elongate strip of material and extending vertically at or adjacent to the waist opening periphery in a direction generally perpendicular thereto, wherein each elongate strip of material constituting each secondary finger pull has a length greater than a distance between the vertically spaced apart attachment locations at which the elongate strip of material is attached thereby defining a respective space between the secondary finger pull and the main garment portion sized to permit at least one of the wearer's fingers to pass therethrough, wherein first, second, third, and fourth vertically extending secondary finger pulls are provided, respectively, between a front center of the main garment portion and a right lateral side of the main garment portion, the front center and a left lateral side of the main garment portion, a rear center of the main garment portion and the right lateral side, and the rear center and the left lateral side, and wherein the plurality of primary finger pulls are provided only between the first and third secondary finger pulls across the right lateral side of the main garment portion and only between the second and fourth secondary finger pulls across the left lateral side of the main garment portion, respectively.

2. The undergarment according to claim 1, wherein at least two horizontally extending primary finger pulls are provided between the first and third vertically extending secondary finger pulls across the right lateral side of the main garment portion and wherein at least two horizontally extending primary finger pulls are provided between the second and fourth vertically extending secondary finger pulls across the left lateral side of the main garment portion.

3. The undergarment according to claim 1, further comprising a fifth vertically extending secondary finger pull provided between the first and third vertically extending secondary finger pulls, and a sixth vertically extending secondary finger pull provided between the second and fourth vertically extending secondary finger pulls.

4. The undergarment according to claim 1, wherein each elongate portion of material constituting each of the horizontally extending primary finger pulls is a strip of decorative trim.

5. The undergarment according to claim 4, wherein each elongate strip of material constituting each of vertically extending secondary finger pulls is a strip of decorative trim.

6. The undergarment according to claim 1, wherein each elongate strip of material constituting each of vertically extending secondary finger pulls is a strip of decorative trim.

7. The undergarment according to claim 1, wherein each elongate portion of material constituting each of the horizontally extending primary finger pulls is a strip of elastic material.

8. The undergarment according to claim 7, wherein each elongate portion of material constituting each of the vertically extending primary finger pulls is a strip of elastic material.

9. The undergarment according to claim 1, wherein each elongate portion of material constituting each of the vertically extending primary finger pulls is a strip of elastic material.

10. The undergarment according to claim 1, wherein the elongate portion of material constituting each horizontally extending primary finger pull is about one-half inch wide.

11. The undergarment according to claim 1, wherein adjacent laterally spaced attachment locations are about 3 to 4 inches apart.

12. The undergarment according to claim 1, wherein each elongate strip of material constituting each vertically extending secondary finger pull is about 3 inches long.

* * * * *